US006065547A

United States Patent [19]

Ellis, Jr. et al.

[11] Patent Number: 6,065,547

[45] Date of Patent: May 23, 2000

[54] APPARATUS AND METHOD FOR FIRE SUPPRESSION

[75] Inventors: Ernest E. Ellis, Jr., Kingsville; Michael C. Sain, Baltimore, both of Md.; Mark L. Robin, Otterbein; Steven T. Ginn, West Lafayette, both of Ind.

[73] Assignees: MetalCraft, Inc., Baltimore, Md.; Great Lakes Chemical Corporation, West Lafayette, Ind.

[21] Appl. No.: 08/862,980

[22] Filed: May 23, 1997

Related U.S. Application Data

[60] Provisional application No. 60/039,356, Mar. 19, 1997.

[51] Int. Cl.[7] ..... A62C 13/76

[52] U.S. Cl. ..... 169/89; 239/499

[58] Field of Search ..... 239/499, 288–288.5; 169/89, 74, 71

[56] References Cited

U.S. PATENT DOCUMENTS

| | | | |
|---|---|---|---|
| 2,375,615 | 5/1945 | Boal | 169/89 |
| 2,744,580 | 5/1956 | Shroeder | 169/89 |
| 2,978,187 | 4/1961 | Hesson | 239/499 |
| 2,985,383 | 5/1961 | Rasmusson et al. | 239/499 |
| 3,051,652 | 8/1962 | Olandt | 252/7 |
| 3,804,759 | 4/1974 | Becker et al. | 252/8 |
| 3,850,373 | 11/1974 | Grolitsch | 239/499 |
| 5,113,947 | 5/1992 | Robin | 169/46 |

FOREIGN PATENT DOCUMENTS

| | | | |
|---|---|---|---|
| 45669 | 5/1966 | Germany | 239/499 |
| 2032286 | 2/1980 | Germany | 169/74 |

*Primary Examiner*—Kevin Weldon

*Attorney, Agent, or Firm*—Marshall, O'Toole, Gerstein, Murray & Borun

[57] ABSTRACT

A fire extinguisher nozzle including a horn defining a discharge chamber and a discharge member mounted to the horn. The discharge member includes an entry passageway for receiving fire extinguishant from a source therefor. The entry passageway communicates with a plurality of transverse discharge passageways and a central, axial passageway for delivering the fire extinguishant into the discharge chamber of the horn. Improved throw characteristics for fire extinguishants are achieved.

18 Claims, 3 Drawing Sheets

APPARATUS AND METHOD FOR FIRE SUPPRESSION

PRIOR RELATED APPLICATION

This application claims priority to United States Provisional Patent Application Ser. No. 60/039,356 filed Mar. 19, 1997.

FIELD OF THE INVENTION

The present invention relates to the field of fire extinguishing compositions and methods for delivering fire extinguishing compositions to a fire, and particularly to an extinguisher nozzle design.

DESCRIPTION OF THE PRIOR ART

Certain halogenated hydrocarbons have been employed as fire extinguishants since the early 1900's. Prior to 1945, the three most widely employed halogenated extinguishing agents were carbon tetrachloride, methyl bromide and bromochloromethane. For toxicological reasons, however, the use of these agents has been discontinued. Until only recently, the two halogenated fire extinguishing agents in common use were the bromine-containing compounds Halon 1301 ($CF_3Br$) and Halon 1211 ($CF_2BrCl$). One of the major advantages of these halogenated fire suppression agents over other fire suppression agents such as water or carbon dioxide is the clean nature of their extinguishment, that is, they leave no residues following their use to extinguish a fire. Hence, the halogenated agents have been employed for the protection of computer rooms, electronic data processing facilities, electronic equipment, marine craft, museums and libraries, where the use of water for example can often cause more secondary damage to the property being protected than is caused by the fire itself.

Although the above named bromine and chlorine containing compounds are effective fire fighting agents, those agents containing bromine or chlorine are asserted to be capable of the destruction of the earth's protective ozone layer. For example, Halon 1301 has an Ozone Depletion Potential (ODP) rating of 10, and Halon 1211 has an ODP of 3. As a result of concerns over ozone depletion, the production and sale of these agents after Jan. 1, 1994 is prohibited under international and United States policy.

It is therefore an object of this invention to provide a method for suppressing fires which is clean and does not require the use of ozone depleting substances, hence being environmentally friendly.

Fire suppression applications can be divided into two areas: total flooding applications and streaming (portable) applications. In the case of total flooding applications, the entire enclosure volume being protected is filled ("flooded") with an extinguishing concentration of the fire suppression agent, and this extinguishing concentration is maintained for some time period, typically 10 minutes, to ensure extinction of the fire. Typical total flooding systems consist of a fixed storage vessel containing the fire suppression agent, a piping network connected to the fixed storage vessel and terminating in a fixed nozzle, typically located at the ceiling of the protected enclosure, and also any associated valving and detection/alarm systems. In the case of streaming (also termed "portable") applications, a fire suppression agent, contained in a portable vessel, is discharged directly onto the burning material. Streaming systems include both handheld and wheeled units.

The suitability of a given fire suppression agent for total flooding or streaming applications is primarily a function of the boiling point of the agent (see, for example, R. E. Tapscott "Replacement Agents—An Historical Overview," Halon Alternatives Technical Working Conference, May 12–14, 1992, Albuquerque, N. Mex., p. 58). Materials with low boiling points are more suitable for total flood applications, while those with high boiling points are better suited for streaming applications. For example, although the inherent fire suppression characteristics of Halon 1301 ($CF_3Br$) and Halon 1211 ($CF_2BrCl$) are very similar, Halon 1301 with a boiling point of −58° C. is employed as a total flooding agent, whereas Halon 1211 with a boiling point of −4°C. is employed as a streaming agent. In general, chemicals with boiling points lower than approximately −15° C. are too gaseous for effective use in streaming applications.

It is therefore a further object of this invention to provide a method for greatly improving the performance of low boiling suppression agents in streaming applications.

Whereas a number of replacements for the total flooding agent Halon 1301 have been proposed and commercialized, at the present time there exists no viable replacement for the streaming agent Halon 1211.

It is therefore a further object of this invention to provide a viable replacement for the streaming agent Halon 1211.

The use of hydrofluorocarbons (HFCs), for example 1,1,1,2,3,3,3-heptafluoropropane ($CF_3CHFCF_3$), as extinguishing agents has been proposed only recently, for example as described in U.S. Pat. No. 5,124,053. Since the hydrofluorocarbons do not contain bromine or chlorine, the compounds have no effect on the stratospheric ozone layer and their ODP is zero. As a result, hydrofluorocarbons such as 1,1,1,2,3,3,3-heptafluoropropane are currently being employed as environmentally friendly replacements for the Halons in fire suppression applications. However, due to its low boiling point (−16° C.), 1,1,1,2,3,3,3-heptafluoropropane has been found to exhibit poor performance when employed in streaming applications.

It is therefore a further object of this invention to provide a method for greatly improving the streaming characteristics of HFCs such as 1,1,1,2,3,3,3-heptafluoropropane.

Further objects of the invention will become apparent from the following description.

DESCRIPTION OF THE PREFERRED EMBODIMENTS

Figure 1:
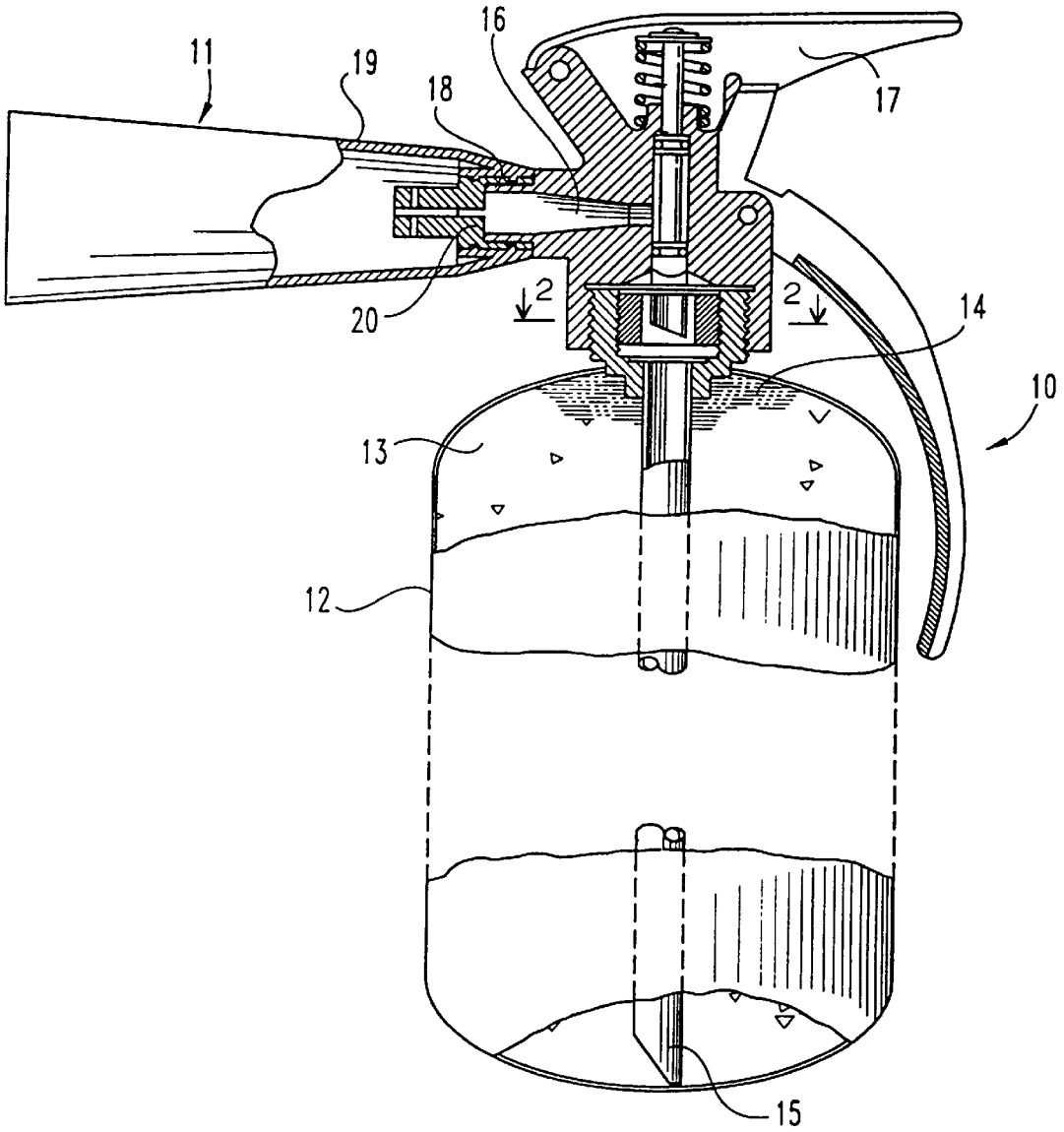
FIG. 1 is a side elevational view, partially in cross section, showing a fire extinguisher and the nozzle design of the present invention.

For the purpose of promoting an understanding of the principles of the invention, reference will now be made to preferred embodiments of the invention and specific language will be used to describe the same. It will nevertheless be understood that no limitation of the scope of the invention is thereby intended, such alterations, further modifications and applications of the principles of the invention as described herein being contemplated as would normally occur to one skilled in the art to which the invention relates.

In accordance with the present invention, it has been found that a vastly improved streaming system is available by employing the present invention. Briefly stated, the present invention is in the provision of a streaming fire extinguisher, comprising either a hand-held or wheeled unit. The inventive system uses a specially designed discharge nozzle that provides improved throw characteristics for the fire extinguishant as compared to alternative nozzle designs.

The extinguisher used with the invention is constructed from any of a variety of suitable materials. The extinguisher is preferably formed of aluminum metal insofar as it is in prolonged contact with the fire extinguishing composition (except the nozzle portion). However, any material compatible with the agent and of sufficient strength to safely accommodate the cylinder pressure is suitable. The preferred metallic components include an aluminum metal pressure-withstanding bottle which has an internally threaded neck at the open end. A metallic or plastic riser pipe extending from near the closed end of the bottle is provided along with an externally threaded metal coupler body which includes means for securing one end of the riser pipe and is adapted for threaded engagement with the internally threaded neck at the open end of the bottle. The bottle is fitted at the open end with a suitable valve to which is attached a removable nozzle assembly.

The present invention is therefore useful with a variety of extinguisher designs. The particular design and construction of the extinguisher body is not critical to the invention, and may be selected from available designs in the prior art. By way of example, U.S. Pat. No. 3,051,652, issued to Olandt, and U.S. Pat. No. 3,804,759, issued to Becker et al, disclose typical extinguisher designs with which the present invention may be used. The construction and use of such extinguishers disclosed in the foregoing patents is hereby incorporated by reference. Since the design of the extinguisher itself does not form a part of the present invention, no further description of the extinguisher is required.

Referring in particular to the drawings, there is shown a fire extinguisher 10 utilizing a nozzle 11 constructed in accordance with the present invention. The extinguisher 10 is of any conventional design, and includes such components as a container 12 including fire extinguishant 13 and propellant 14. Tube 15 extends down into the extinguishant in the container and is coupled to the outlet 16. The handle 17 is operable, as explained for example in the Olandt U.S. Pat. No. 3,051,652, to release the extinguishant from the container through the outlet 16.

The nozzle 11 is connected to the extinguisher 10 in any suitable manner. The nozzle may be integrally formed with a component of the extinguisher, but more conveniently is separately fabricated and then attached to the extinguisher such as by a threaded coupling. By way of example, there is shown an externally-threaded extension 18 which receives an internally-threaded portion of the nozzle for securement therewith.

The construction of the nozzle 11 is shown in detail in the drawings. The nozzle includes a horn 19 and a discharge member 20. The discharge member may be separately fabricated and then attached to the horn, or could be integrally formed therewith. The horn provides a suitable discharge chamber 21 from which the extinguishant is expelled, and the discharge member provides a desired entry for the extinguishant from the extinguisher and into the discharge chamber to yield an advantageous "throw" of the extinguishant.

The horn has proximal end 22 for attachment to a fire extinguisher and an open distal end 23 for exiting of the fire extinguishant, and defines a generally central axis 24 therebetween. As will be appreciated, the horn will typically have a preferred shape which expands in the direction from the proximal end to the distal end, although this is not a requirement for the invention. Any shape or configuration, including any cross-sectional design, is contemplated for the invention. For purposes of description, the horn is shown with a frusto-conical shape, which is conventional for horn shapes. The horn includes internal, radially-extending ribs 25 which provide strength to the horn, particularly in the region at which the horn is coupled with the discharge member 20.

The discharge member 20 is mounted to the horn 19 at the proximal end. The discharge member includes an entry passageway 26 for communicating with the source of fire extinguishant. In addition, the member 20 includes a plurality of non-axial discharge passageways 27 and a central, axially extending discharge passageway 28, all opening into the discharge chamber 21 of the horn. In a preferred embodiment, the discharge member 20 includes 2–24, preferably 2–8, non-axial discharge passageways. The member 20 is therefore coupled with the horn and secured to the fire extinguisher in such a way that extinguishant is received in the entry passageway 26 and directed through the non-axial and central discharge passageways into the discharge chamber and out the distal end of the horn to the fire.

Figure 4:
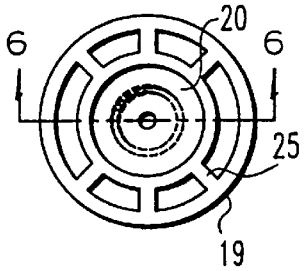
FIG. 4 is a cross-sectional view of the nozzle of FIG. 3, taken along the line 3—3 and looking in the direction of the arrows.
Figure 6:
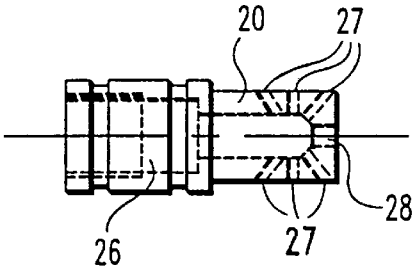
FIG. 6 is a side, elevational view, partially in cross section, of a discharge member used in the present invention depicting non-axial discharge passageways at multiple angles.
Figure 9:
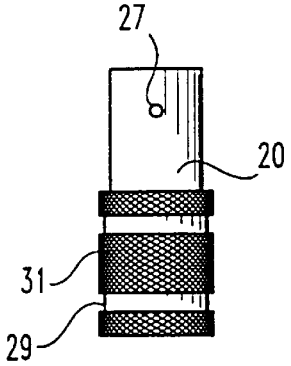
FIG. 9 is an elevational view of the discharge member of the present invention.

The number and orientation of the non-axial discharge passageways may be selected to optimize the performance of the nozzle for a given extinguishant. The non-axial passageways direct the extinguishant in a direction other than axially through the horn, and operate to provide different discharge characteristics for the extinguishant. Several options for the orientation of the passageways exist. The passageways may be simply directed radially from the entry passageway, that is in a plane normal to the axis of the horn. Alternatively, as shown in FIG. 4 the passageways may be directed in a plane normal to the horn axis but angled other than radially, that is anywhere from nearly radial to nearly tangential, preferably from 50° to 85° from radial, thus providing a rotational or swirling component to the travel of the extinguishant from the member 20 and through the horn. The non-axial passageways may also be directed other than normal to the horn axis, thereby providing either forward or backward direction to the extinguishant as it exits the member 20. Such passageways may be preferably angled from 5° to 85°, preferably from 5° to 45°, from normal to the horn axis.

The present invention contemplates that the non-axial passageways may be oriented in any of the foregoing ways, as is determined to be best suited to the fire extinguisher and extinguishant employed and the throw characteristics desired. Any combination of radial, rotational, forward and/or backward directed passageways are used to obtain the required effect.

Figure 2:
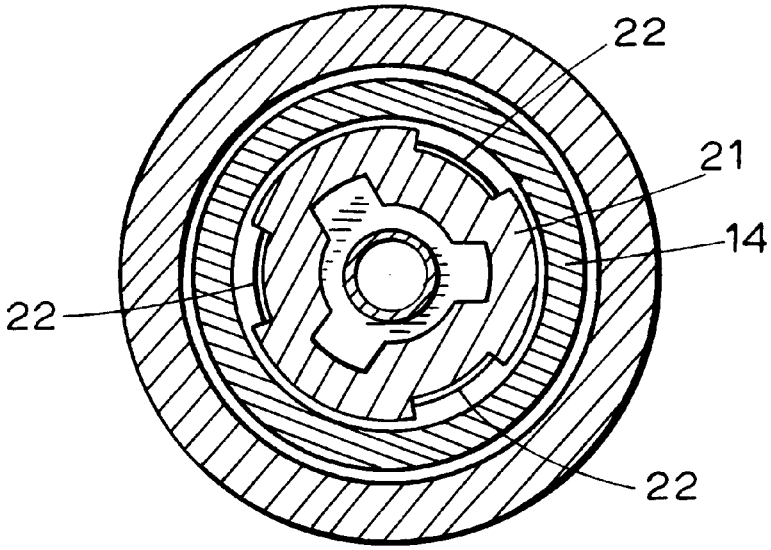
FIG. 2 is a cross-sectional view of FIG. 1.
Figure 7:
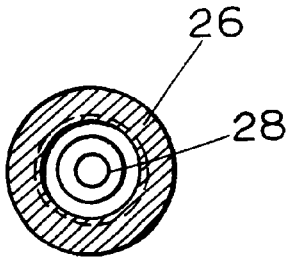
FIG. 7 is a cross-sectional view of FIG. 6.
Figure 8:
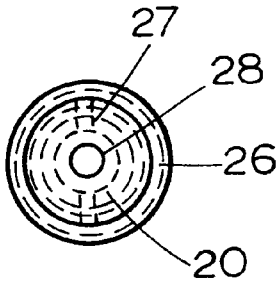
FIG. 8 is a an end view of FIG. 6.
Figure 3:
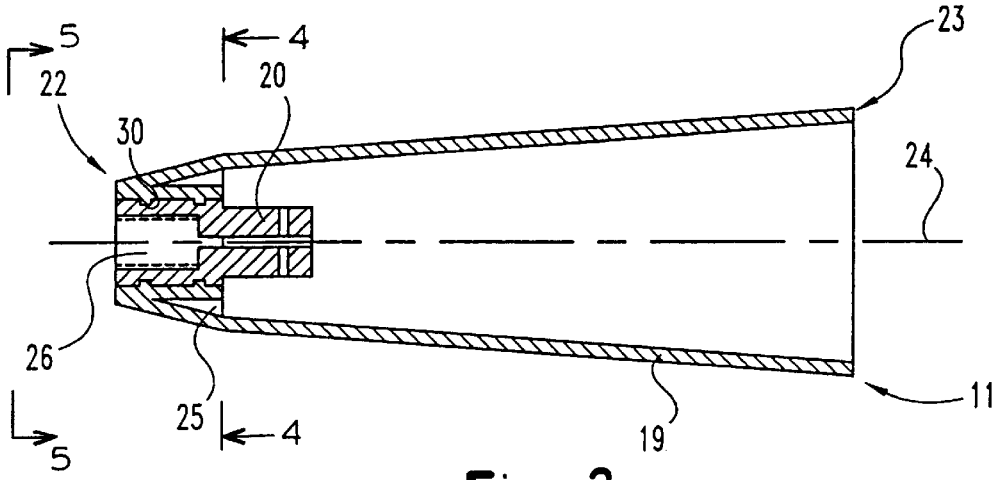
FIG. 3 is a cross-sectional view of the fire extinguisher nozzle of the present invention.
Figure 5:
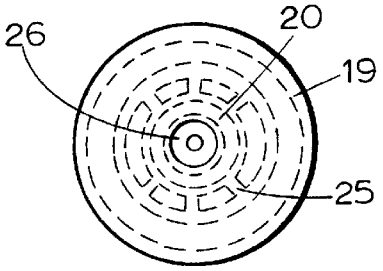
FIG. 5 is an end view of FIG. 3.

The discharge member 20 preferably has a generally cylindrical shape and is received within the horn. The member includes a pair of circumferential grooves 29 which receive complementary ridges 30 (FIG. 2) on the horn to assure a proper seating of the insert within the horn, for example by means of a snap fit between the two components. The outer surface 31 of the member 20 in the area surrounding the grooves is provided with a knurled surface to facilitate the securement of the member with the horn.

The components of the present invention may be fabricated from any material providing the required properties in use. The horn body is preferably constructed of plastic such as urea formaldehyde or Bakelite. The discharge member is preferably constructed of a suitable metal such as brass or aluminum, or alternatively may be constructed of plastic.

The fire extinguisher is completed by a fire extinguishing composition. Preferably a fire suppression agent of zero or low ODP is employed, for example an agent selected from the groups of hydrofluorocarbons (FCs), hydrochlorofluorocarbons (HCFCs), and fluorinated O-containing and flourinated N-containing agents. Specific fire suppression agents useful in accordance with the present invention include compounds selected from the chemical compound classes of the hydrofluorocarbons and hydrochlorofluorocarbons. Specific hydrofluorocarbons useful in accordance with the present invention include pentafluoroethane ($CF_3CF_2H$), 1,1,1,2-tetrafluoroethane ($CF_3CH_2F$), 1,1,2,2-tetrafluoroethane ($HCF_2CF_2H$), 1,1,1,2,3,3,3-heptafluoropropane ($CF_3CHFCF_3$), 1,1,1,2,2,3,3-heptafluoropropane ($CF_3CF_2CF_2H$), 1,1,1,3,3,3-hexafluoropropane ($CF_3CH_2CF_3$), 1,1,1,2,3,3-hexafluoropropane ($CF_3CHFCF_2H$), 1,1,2,2,3,3-hexafluoropropane ($HCF_2CF_2CF_2H$), and 1,1,1,2,2,3-hexafluoropropane ($CF_3CF_2CH_2F$). Specific hydrochlorofluorocarbons useful in accordance with the present invention include chlorodifluoromethane ($CF_2HCl$), 2,2-dichloro-1,1,1-trifluoroethane ($CF_3CHCl_2$) and 2-chloro-1,1,1,2-tetrafluoroethane ($CF_3CHFCl$). It is also an aspect of the present invention that combinations of the above mentioned agents may be employed to provide a blend having improved characteristics in terms of efficacy, toxicity and/or environmental safety.

In addition to the fire suppression agent, a pressurizing gas may also be employed. Specific means of agent pressurization useful in accordance with the present invention include pressurization by inert gases. Specific inert gases useful in accordance with the present invention include nitrogen, argon and carbon dioxide. Pressurization levels range from a total pressure of 30 to 1200 psig, preferably from approximately 150 to 360 psig.

The insert includes an enlarged fire passageway which connects with a reduced discharge passageway that extends along the centerline of the insert through the end of the insert. In addition, several radially-directed holes communicate with the discharge passageway and extend to the exterior of the insert within the horn. As a result, fire extinguishant being discharged through the nozzle will pass through the central and side discharge passageways.

EXAMPLES

The invention will be further described with reference to the following specific Examples. However, it will be understood that these Examples are illustrative and not restrictive in nature.

Example 1

This example demonstrates the poor performance of a low boiling fire suppression agent in streaming applications when employing standard extinguishing equipment. 1,1,1,2,3,3,3-Heptafluoropropane was charged to a standard fire extinguishing cylinder equipped with a standard nozzle with an orifice diameter as indicated in Table I; the orifice diameter was adjusted to obtain a total discharge time of nominal 10 seconds. The cylinder was then pressurized with dry nitrogen to the indicated charge pressure. A 5 $ft^2$ metal pan, 8" tall, was filled with a two inch layer of water, followed by a 2 inch layer of n-heptane. The n-heptane was then ignited and allowed to burn 60 seconds before attempting to extinguish the fire. As seen from Table I, extinguishment was not accomplished employing a variety of conditions and employing up to 8 pounds of the 1,1,1,2,3,3,3-heptafluoropropane agent.

TABLE I

STREAMING TESTS; STANDARD HORN

| Pounds of Agent Charged | Charge pressure psig | Conditioning Temperature | Horn Type | Extinguishment |
|---|---|---|---|---|
| 3 | 360 | RT | Standard 0.125 | NO |
| 3 | 360 | RT | Standard 0.125 | NO |
| 3 | 240 | RT | Standard 0.125 | NO |
| 3 | 240 | RT | Standard 0.125 | NO |
| 3 | 240 | RT | Standard 0.140 | NO |
| 3 | 240 | RT | Standard 0.140 | NO |
| 4 | 240 | RT | Standard 0.169 | NO |
| 4 | 240 | RT | Standard 0.169 | NO |
| 6 | 240 | RT | Standard 0.187 | NO |
| 6 | 240 | RT | Standard 0.187 | NO |
| 8 | 240 | RT | Standard 0.265 | NO |
| 8 | 240 | RT | Standard 0.265 | NO |

Example 2

This example demonstrates the great improvement obtained employing the present invention. The identical procedure was employed as described as in EXAMPLE 1 with the exception of the use of the nozzle assembly of the current invention. The nozzle insert in this case contained two 0.062 inch diameter holes located 180° apart and directed radially, i.e., at an angle of 90° from the axis of the horn, and a single outlet of diameter 0.140 inch directed axially, i.e., parallel to the axis of the horn assembly. Extinguishment was achieved in all tests, employing as little as 1.5 pounds of the 1,1,1,2,3,3,3-heptafluoropropane agent.

TABLE II

STREAMING TESTS; MODIFIED HORN

| Pounds of Agent Charged | Pounds of Agent Discharged | Charge pressure psig | Conditioning Temperature | Extinguishment |
|---|---|---|---|---|
| 3 | 1.6 | 360 | RT | YES |
| 3 | 1.5 | 360 | RT | YES |
| 3 | 2 | 360 | RT | YES |
| 3 | 1.6 | 360 | −40° C. | YES |

The results obtained with the modified horn are totally unexpected. By directing a portion of the agent flow away from the axis of the horn assembly, it would be expected that the "throw", i.e., the ability to project a stream of the agent over a distance, would be reduced, hence reducing the efficiency of the agent in streaming applications. However, as seen from the examples, the streaming performance was instead greatly enhanced. Also surprisingly, it was found that the performance of high boiling agents such as 2,2-dichloro-1,1,1-trifluoroethane ($CF_3CHCl_2$) is greatly enhanced by employment of the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fire extinguisher streaming nozzle for attachment to a fire extinguisher providing a source of fire extinguishant for discharge of a liquid stream of the fire extinguishant through said nozzle, which comprises:

a. a horn having proximal and distal ends and defining an axis there between, the proximal end being attachable to a fire extinguisher, the distal end being open for exiting of a fire extinguishing agent, said horn defining a discharge chamber extending from the proximal end to the distal end, the discharge chamber communicating with the open distal end; and b. a discharge member mounted to said horn at the proximal end for discharging fire extinguishant into the discharge chamber, said discharge member defining an entry passageway for communicating with a source of fire extinguishing agent, said discharge member further including a central, axially extending discharge passageway communicating with the entry passageway and opening into the discharge chamber of said horn and a plurality of non-axial discharge passageways communicating with the entry passageway and opening into the discharge chamber of said horn.

2. The nozzle of claim 1 which includes from 2 to 24 non-axial discharge passageways.

3. The nozzle of claim 1 in which the discharge chamber of said horn expands in size in the direction from the proximal end to the distal end.

4. The nozzle of claim 1 in which said discharge member is a separate member inserted into and secured to said horn.

5. The nozzle of claim 1 in which at least one of the non-axial discharge passageways extends radially from said discharge member in a plane normal to the axis of said horn.

6. The nozzle of claim 1 in which at least one of the non-axial discharge passageways extends at an angle to radially from said discharge member in a plane normal to the axis of said horn.

7. The nozzle of claim 6 in which the at least one non-axial discharge passageways extend at an angle of from 5° to 85° from radial.

8. The nozzle of claim 6 in which at least one of the non-axial discharge passageways extends radially from said discharge member in a plane normal to the axis of said horn.

9. The nozzle of claim 1 in which at least one of the non-axial discharge passageways extends at an angle to normal to the axis of said horn.

10. The nozzle of claim 9 in which the at least one transverse discharge passageways extend at an angle of from 5° to 45° from normal.

11. The nozzle of claim 10 in which at least one of the non-axial discharge passageways extends radially from said discharge member in a plane normal to the axis of said horn.

12. The nozzle of claim 9 in which at least one of the non-axial discharge passageways extends at an angle to radially from said discharge member in a plane normal to the axis of said horn.

13. The nozzle of claim 12 in which at least one of the non-axial discharge passageways extends radially from said discharge member in a plane normal to the axis of said horn.

14. The nozzle of claim 1 in which the central discharge passageway has a uniform cross-section throughout its length.

15. The nozzle of claim 1 in which the central discharge passageway is configured to provide a liquid stream of fire extinguishant there through.

16. A fire extinguisher system which comprises:

a fire extinguisher containing a source of fire extinguishing agent for discharge through a nozzle, the fire extinguishing agent being selected from the group consisting of: pentafluoroethane, tetrafluoroethane, heptafluoropropane, hexafluoropropane, chlorodifluoromethane, dichlorotrifluoroethane and chlorotetrafluoroethane; and a nozzle mounted to said fire extinguisher, said nozzle including a horn having proximal and distal ends and defining an axis there between, the proximal end being attached to said fire extinguisher, the distal end being open for exiting of the fire extinguishing agent, said horn defining a discharge chamber extending from the proximal end to the distal end, the discharge chamber communicating with the open distal end, said nozzle further including a discharge member mounted to the horn at the proximal end for discharging the fire extinguishing agent into the discharge chamber, the discharge member defining an entry passageway for communicating with the source of fire extinguishing agent, the discharge member further including a central, axially extending discharge passageway communicating with the entry passageway and opening into the discharge chamber of said horn and a plurality of non-axial discharge passageways communicating with the entry passageway and opening into the discharge chamber of the horn.

17. The fire extinguisher system of claim 16 in which the central discharge passageway has a uniform cross-section throughout its length.

18. The fire extinguisher system of claim 16 in which the fire extinguishing agent is heptafluoropropane.

* * * * *